US005711559A

United States Patent [19]

Davis

[11] Patent Number: 5,711,559

[45] Date of Patent: Jan. 27, 1998

[54] AUTOMOBILE TRUNK LID RELEASE

[76] Inventor: Roland L. Davis, 2024 Tournament Dr., Apopka, Fla. 32712

[21] Appl. No.: 551,069

[22] Filed: Oct. 31, 1995

Related U.S. Application Data

[63] Continuation-in-part of Ser. No. 227,967, Apr. 15, 1994, Pat. No. 5,462,320.

[51] Int. Cl.[6] ..... E05B 15/02

[52] U.S. Cl. ..... 292/340; 292/DIG. 65

[58] Field of Search ..... 292/340, 92, DIG. 65

[56] References Cited

U.S. PATENT DOCUMENTS

| | | | |
|---|---|---|---|
| 2,275,760 | 3/1942 | Hoffman | 292/281 |
| 2,618,498 | 11/1952 | Schlesser | 292/340 |
| 2,823,940 | 2/1958 | Squire | 292/92 |
| 4,431,220 | 2/1984 | Loughlin | 292/340 |
| 4,602,813 | 7/1986 | Gergoe et al. | 292/340 |
| 4,635,977 | 1/1987 | Yamada | 292/92 |
| 4,756,565 | 7/1988 | Myslicki et al. | 292/340 |

FOREIGN PATENT DOCUMENTS

| | | | |
|---|---|---|---|
| 1-223276 | 9/1989 | Japan | 292/340 |

*Primary Examiner*—Rodney M. Lindsey
*Attorney, Agent, or Firm*—James H. Beusse

[57] ABSTRACT

A safety release mechanism for releasing a trunk lid of an automobile from within the trunk, the trunk lid including a latch for engaging a staple adapted for mounting on a standard inside the trunk of the automobile, comprises a single threaded attachment element for coupling the staple to the standard. The attachment element has an enlarged handle positioned for grasping by a person's hand from within the trunk for rotating the attachment element to release the staple from the standard.

4 Claims, 2 Drawing Sheets

AUTOMOBILE TRUNK LID RELEASE

This is a continuation-in-part of application Ser. No. 08/227,967, filed Apr. 15, 1994 now U.S. Pat. No. 5,462,320.

This invention relates to a system wherein a hasp installed within an enclosure to limit access to space therein is made removable from inside the space to allow a person trapped therein to escape.

BACKGROUND OF THE INVENTION

In U.S. Pat. No. 5,462,320, there is disclosed a release mechanism for a hasp and staple assembly. In general, a hasp is a security device having a slotted flap connected at a pin joint to a hinge portion attached by screws to a door or door casement. The slotted part pivots into a "closed" position over the eye ring of a staple attached by screws to the other of the door or door casement. When closed, the flap conceals the screw holes on both the hinge portion and staple plate, so that when a padlock is passed through the eye ring and locked, an intruder cannot unscrew the screws with a screwdriver.

Conventional hasps come in various styles and sizes, with lengths of typically 2¼" to 6¼" and widths of 1" to 2". Though hasps are commonly used on doors, the same also can be used to lock lids of chests and for other types of closures as well.

It is customary to apply a padlock and hasp, in addition to a factory-installed latch, on the doors of walk-in freezers and similar storage containers in the food service industry. Where hasps are employed on enclosures to limit access to large internal spaces, however, there is a risk that a person will become intentionally or unintentionally locked within the closure. This could occur, for example, where a kitchen employee is inadvertently locked in a meat storage cooler, or where a number of employees are locked into confinement during a robbery. In accordance with the invention of U.S. Pat. No. 5,462,320, one or both of the hasp hinge or staple plate are removably secured by a fastener passed externally from the inside of the confinement space. A preferred embodiment utilizes a threaded rod having a grippable handle. The rod is passed through a bore in the door or casement and threaded into a screw hole of the hasp hinge or staple plate. The rod is then cut off to avoid interference with operation of the flap. Thereafter, should a person become trapped within the hasp-protected enclosure, rotation of the handle from inside the enclosure will unscrew the rod, causing the hinge or staple plate to be freed for opening the closure.

Another application where staples are used in a locking mechanism are in trunk lid fasteners in automobiles. These fasteners do not use the slotted flap and separate lock to close the trunk lid but rather use an integral latching mechanism within the trunk lid which grasps the protruding portion of the staple inside the trunk of the automobile. Once the lid has been closed, it is not generally possible for someone inside the trunk to release the latching mechanism in order to open the trunk. There are a number of situations in which it would be desirable to have such a feature. For example, children playing around an open trunk automobile may perhaps close the lid while they are inside and thus not be able to escape. More commonly, car jackings often culminate in the car owner being forcibly locked into the trunk of the car. If the person is not found within a reasonable length of time, it is entirely possible that the person locked in the car may not survive. Accordingly, it is desirable to provide a release mechanism which allows a person locked into the trunk of a vehicle to escape from the trunk by releasing the trunk lid from within the vehicle trunk.

SUMMARY OF THE INVENTION

In accordance with the present invention, there is provided a mechanism for releasably connecting the staple of an automobile trunk lid latch so that a person within the trunk can release the staple and thus allow the lid to be opened. In a preferred form, the staple is attached to a conventional mounting stand within the trunk using a threaded rod having a large grippable handle. The rod passes through a bore in the mounting stand and threads into a screw hole on the staple plate. The length of the rod is selected so as to avoid interference with the operation of the trunk latch while still providing sufficient retentive power to hold the staple in place. With the use of the present invention, a person becoming trapped within the trunk of an automobile can rotate the handle from inside the trunk and unscrew the rod causing the staple to be released so that the trunk lid can be opened.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
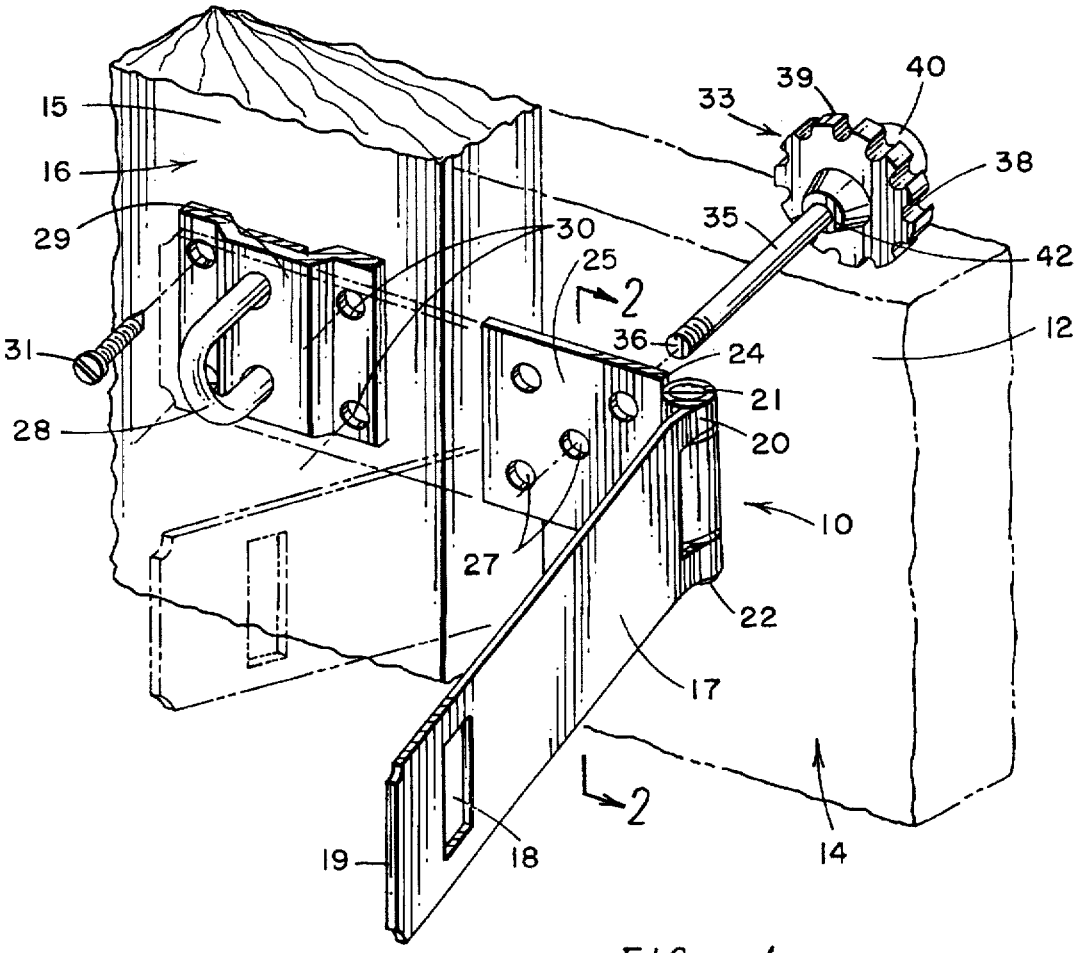
FIG. 1 is an exploded view of a safety hasp system in accordance with U.S. Pat. No. 5,462,320.
Figure 2:
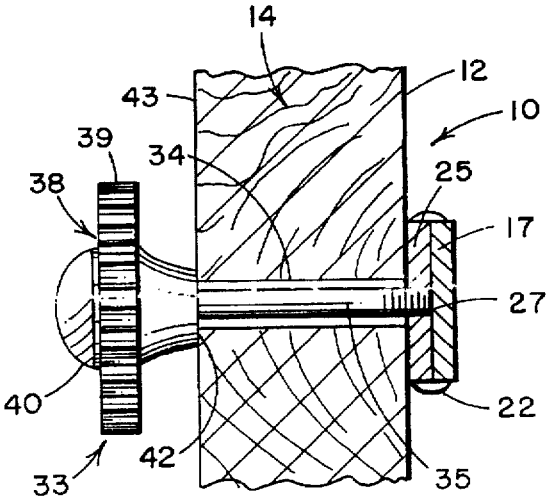
FIG. 2 is a sectional view taken along the line of 2—2 of FIG. 1.
Figure 3:
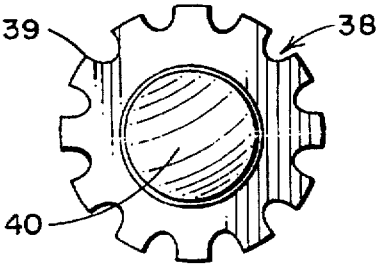
FIG. 3 is a top plan view of the handle end of the fastening rod used to removably secure the hasp in the arrangement shown in FIGS. 1 and 2.

Before turning to the details of the present invention, reference will first be made to FIGS. 1–3 which disclose a safety hasp with a releasable mechanism as described in the aforementioned U.S. Pat. No. 5,462,320. As will be appreciated, the teachings of the present patent are applied to the present invention and therefore an understanding of the prior patent will facilitate an understanding of the present invention.

A safety hasp 10 comprises two parts, one attached to an external surface 12 of a walk-in cooler door 14 (shown in phantom in FIG. 1 and in solid lines in FIG. 2) and another attached to an external surface 15 of a door frame 16 of the same cooler. The first part includes, in conventional manner, an elongated planar, generally rectangular flap or strap 17 having a vertical slot 18 adjacent a free first end 19, and a bifurcated second end 20 forming a vertical cylindrical channel 21, through which a pin 22 is passed for pivotal attachment of end 20 to a first lateral edge 24 of a hinge plate portion 25. Hinge plate 25 includes one or more apertures 27 through which fastening means may be threaded to surface 12, externally of the walk-in cooler.

The second part of the hasp system includes an eye ring 28 which projects outwardly from a staple plate base portion 29 and assumes the same vertical orientation as slot 18. In conventional manner, plate 29 has a plurality of screw hole apertures 30 through which conventional screw fasteners 31 are passed for attachment of the second part to surface 15, externally of the walk-in cooler. The first and second parts of the hasp system are relatively dimensioned, configured and adapted so that when the flap 17 is brought from its "open" (shown by solid lines in FIG. 1) to its "closed" (shown by dot-dot-dashed lines in FIG. 1 and solid lines in FIG. 2) position, slot 18 is brought over eye ring 28 for securement of flap 17 in its closed position, with flap 18 covering and concealing the apertures 27, 30 by passing a shackle of a padlock through ring 28.

In accordance with the invention, at least one of the hasp system first and second parts is secured to the corresponding door 14 or door frame 16 from inside the cooler. For the illustrated example, conventional slotted screws 31 are passed in the usual manner to secure hinge plate 25 to door frame 16 from outside the enclosure. The shanks of screws 31 are passed through apertures 30 and threaded into frame 16. In the closed position, the free end 19 of flap 17 covers the heads of screws 31 to prevent their removal. Hinge plate 25 is, however, secured to surface 12 of door 14 by passing a specially configured fastening element 33 from inside the cooler, through a horizontal bore 34 that passes through door 14, and into threaded engagement with a hole 27.

The illustrated embodiment shows a fastening element 33 comprising a length of stainless steel or brass rod 35 which is threaded at a leading end 36 and centrally attached at a trailing end to a grippable handle 38. Handle 38 includes a radially outwardly extending circular disc portion 39, which is circumferentially notched to provide angularly spaced alternating ridges and valleys. Such circumferential contouring both facilitates gripping and enables ready recognition of the handle by feel, in the absence of light. An illuminator 40 is located on the rear face of disc portion 39 for providing temporary "emergency" lighting. Illuminator 40 may take the form of a battery operated flashlight which includes a rotatable lens or on-off switch for energizing a light bulb located within handle 38. Illuminator 40 may, alternatively, take the form of a luminescent chemical substance contained within the handle and activated by kneading or the like.

Figure 4:
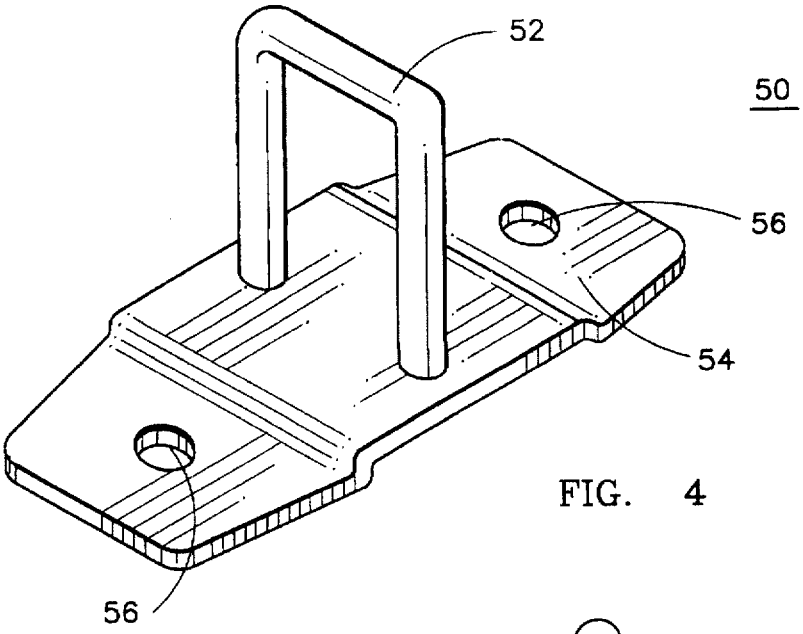
FIG. 4 is a simplified perspective view of a typical staple used in an automobile trunk lid latch assembly.

The security hasp 10 is installed by passing rod 35 through bore 34, from inside the cooler, and threading it into an aperture 27 of hinge plate 25. Rod 35 is threaded into aperture 27 until an enlargement at base 42 of handle 38 is brought flush into engagement with an internal surface 43 of door 14 (see FIG. 2). The leading portion of rod 35, if any, that projects beyond the front surface of hinge plate 25 is then cut off, so that there is no obstruction to movement of the flap 17 into its closed position. Turning now to FIG. 4, there is shown a perspective view of a conventional staple assembly used in a latch system for an automobile trunk lid. As will be appreciated, the staple shown at 50 in FIG. 4 is similar in appearance to the staple shown in FIG. 1. The staple 50 includes an eye ring portion 52 which projects outwardly from a staple base plate portion 54. The staple 50 includes a pair of mounting holes 56 which are used to mount the staple to a stand or standard within the automobile trunk enclosure. Typically, the staple 50 is mounted to such a standard by means of nuts and bolts passing through the holes 56 and similarly aligned holes in the stand.

Figure 5:
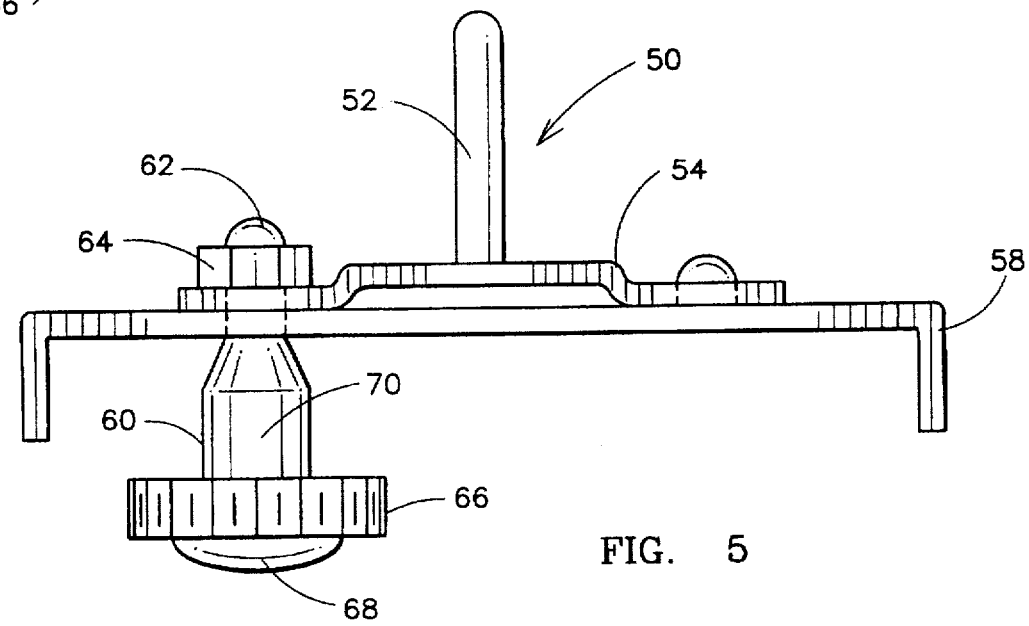
FIG. 5 is a plan view of the staple of FIG. 4 attached to a mounting stand by a manually releasable device in accordance with the present invention.

Referring to FIG. 5, there is shown a plan view of the staple 50 situated on a representation of a staple standard 58. In the illustrative embodiment, the existing holes 56 in the staple 50 are utilized for mounting the staple to the standard 58. In one form, one of the mounting bolts is discarded and replaced by a stud that projects through one of the apertures 56. The stud is used only to secure the staple 50 against rotation about the other mounting hole. In the other mounting hole 56, a specially configured fastening element 60 passes through the hole in the standard 58 from beneath and into the second aperture 56. The fastening element 60 includes a short threaded portion of rod 62 on which a nut 64 on the top side of staple 50 is threaded. In a preferred form, the nut 64 would be welded to the staple 50 so that the nut would not turn when the fastening element 60 is rotated to withdraw the rod 62 from the nut. Alternately, the staple 50 could be modified to have smaller holes 56 that can be directly tapped in the manner illustrated in FIG. 1 of the '320 patent so as to eliminate the need for the nut 64. Methods other than welding may also be provided for attaching the nut 64 to the staple base plate portion 54 in order to minimize rotation of the nut 64 if the releasing element 60 is rotated. Still further, other forms of coupling between the element 60 and staple 50 may be utilized rather than the illustrated threaded connection. For example, the rod 62 may have a radially extending member and the aperture 56 may be slotted to pass such member when the rod is turned. In such instance, spring loading may be used to compress the staple to the standard. Another option is to use an overcenter latch to couple the staple to the standard.

The release element 60 has many of the configurations illustrated in the '320 patent, preferably including at least a serrated circular disc portion 39 to provide a gripping surface for the hand. The element 60 may also include an illuminator 68 enabling the handle 66 to be easily identified in a darkened automobile trunk. The method of illuminating the element 68 is described above with reference to the '320 patent. The fastening element 60 also includes an enlarged shank area 70 connecting the rod 62 to the handle 66. The shank area 70 provides an abutting surface against the lower side of the standard 58 and also provides a convenient method of attaching the slotted rod 62 to the handle 66.

Figure 6:
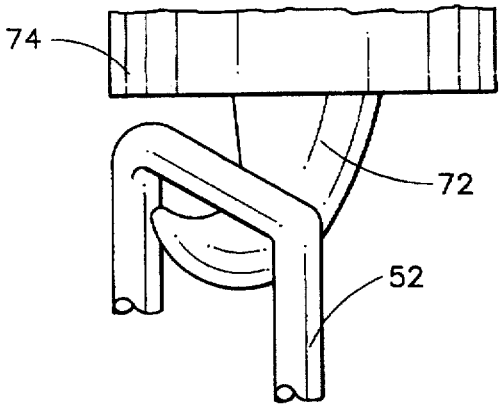
FIG. 6 is a simplified perspective view of a staple and latch assembly used in a trunk lid latch system.

FIG. 6 shows the eye ring 52 being engaged by a pivoting latch member 72 depending from a trunk lid latch assembly 74. As is well known, the latch assembly is controlled within the trunk lid and is generally not accessible without special tools. Furthermore, once the latch 72 has engaged the eye ring 52, a mechanism drops into place to prevent the latch 72 from merely being pushed sideways to release the trunk lid from the eye ring 52.

As will be appreciated, the present invention utilizes the release element 33 of the aforementioned U.S. Pat. No. 5,462,320 to releasably attach a staple assembly to a standard within an automobile trunk. By simply grasping the outer ring 66 of the assembly 60, a person in the trunk can release the staple assembly and thus allow the trunk lid to be opened from within the trunk enclosure. It will also be appreciated that various types of staple assemblies are used in different styles of automobiles but that each of those assemblies generally comprises some type of eye ring which is engaged by a swinging latch such as that illustrated at 72 in FIG. 6 and that all of the eye rings are attached to an elevated mounting standard. While some eye rings are formed of bent metal rods without having a base plate portion, the metal rods are still held in place by bolts or other types of fasteners which connect the ring to a standard such as that shown at 58. The standards themselves may take different forms from automobile to automobile but generally have an upper surface adapted for attachment of an eye ring assembly. In addition, some of the eye ring assemblies or staples may be attached by means of rivets rather than bolts. In such instances, the staples can be removed by drilling the rivets out of the system and reattaching the staple using the apparatus as illustrated in FIG. 5.

While the invention has been described in what is presently considered to be a preferred embodiment, various modifications and improvements will become apparent to those skilled in the art. It is intended therefore that the invention not be limited to the specific disclosed embodiment but be interpreted within the full spirit and scope of the appended claims.

What is claimed is:

1. A safety release mechanism for releasing a trunk lid of an automobile from within a trunk thereof, the trunk lid including a latch for engaging a staple adapted for mounting on a standard inside the trunk of the automobile, the improvement comprising a single threaded attachment means for coupling the staple to the standard, the attachment means having an enlarged handle positioned for grasping by a person's hand from within the trunk for rotating the attachment means to release the staple from the standard.

2. The safety release mechanism of claim 1 wherein the staple includes an eye ring connected to a staple plate, said attachment means including a threaded end for passing through the standard and into a threaded aperture in said plate and further including a non-threaded portion for reacting against the standard.

3. The safety release mechanism of claim 2 wherein said staple plate includes a second aperture adapted for receiving an unthreaded stud for preventing rotation of said plate about said threaded aperture.

4. A trunk lid release system for a trunk lid of a trunk of an automobile, the trunk lid being latched in a closed position by a latching mechanism engaging an eye ring of a staple, the staple being mounted on a standard within the trunk, the improvement comprising apparatus for releasably coupling the staple to the standard whereby the staple can be manually released from the standard without use of any tool.

* * * * *